US011445324B2

(12) United States Patent
Wang et al.

(10) Patent No.: US 11,445,324 B2
(45) Date of Patent: Sep. 13, 2022

(54) AUDIO RENDERING METHOD AND APPARATUS

(71) Applicant: Huawei Technologies Co., Ltd., Shenzhen (CN)

(72) Inventors: Bin Wang, Beijing (CN); Zexin Liu, Beijing (CN); Risheng Xia, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 17/240,655

(22) Filed: Apr. 26, 2021

(65) Prior Publication Data

US 2021/0250723 A1 Aug. 12, 2021

Related U.S. Application Data

(63) Continuation of application No. PCT/CN2019/111620, filed on Oct. 17, 2019.

(30) Foreign Application Priority Data

Oct. 26, 2018 (CN) ..... 201811261215.3

(51) Int. Cl.

| | |
|---|---|
| ***H04S 7/00*** | (2006.01) |
| ***G10L 25/18*** | (2013.01) |
| ***G10L 25/21*** | (2013.01) |

(52) U.S. Cl.

CPC ..... *H04S 7/307* (2013.01); *G10L 25/18* (2013.01); *G10L 25/21* (2013.01); *H04S 2420/01* (2013.01)

(58) Field of Classification Search

CPC ..... H04S 7/307; H04S 2420/01; G10L 25/18; G10L 25/21

See application file for complete search history.

(56) References Cited

U.S. PATENT DOCUMENTS

2012/0093323 A1 4/2012 Lee et al.
2016/0337779 A1* 11/2016 Davidson ..... H04S 7/306

(Continued)

FOREIGN PATENT DOCUMENTS

| | | | |
|---|---|---|---|
| CN | 101390443 | A | 3/2009 |
| CN | 102665156 | A | 9/2012 |
| CN | 103355001 | A | 10/2013 |
| CN | 104240695 | A | 12/2014 |
| CN | 104903955 | A | 9/2015 |

(Continued)

OTHER PUBLICATIONS

Zhang Yang et al., "Present situation and development of 3D audio technology in virtual reality," Audio Engineering, Issue 6, total 8 pages (2017).

(Continued)

*Primary Examiner* — David L Ton

(74) *Attorney, Agent, or Firm* — Leydig, Voit & Mayer, Ltd.

(57) ABSTRACT

This application provides an audio rendering method, including: obtaining a to-be-rendered BRIR signal, where an elevation angle corresponding to the to-be-rendered BRIR signal is 0 degrees; obtaining a direct sound signal based on the to-be-rendered BRIR signal; correcting, based on a target elevation angle, a frequency-domain signal corresponding to the direct sound signal, to obtain a frequency-domain signal corresponding to the target elevation angle; obtaining a time-domain signal based on the frequency-domain signal of the target elevation angle; and superposing the time-domain signal on a signal that is in the to-be-rendered BRIR signal and that is in a second time period after a first time period, to obtain a BRIR signal of the target elevation angle.

20 Claims, 6 Drawing Sheets

(56) References Cited

U.S. PATENT DOCUMENTS

| | | | | |
|---|---|---|---|---|
| 2017/0325043 | A1 | 11/2017 | Jot et al. | |
| 2018/0242094 | A1* | 8/2018 | Baek | H04S 7/304 |
| 2018/0249279 | A1* | 8/2018 | Karapetyan | H04R 3/04 |
| 2019/0215637 | A1* | 7/2019 | Lee | H04R 5/04 |
| 2020/0162833 | A1* | 5/2020 | Lee | H04R 5/02 |

FOREIGN PATENT DOCUMENTS

| | | | | | |
|---|---|---|---|---|---|
| CN | 104982042 | A | | 10/2015 | |
| CN | 105325015 | A | | 2/2016 | |
| CN | 105580070 | A | | 5/2016 | |
| CN | 105900457 | A | | 8/2016 | |
| CN | 106165452 | A | | 11/2016 | |
| CN | 106664497 | A | | 5/2017 | |
| CN | 107710774 | A | | 2/2018 | |
| KR | 20150114874 | A | * | 10/2015 | H04S 7/30 |
| KR | 20160020572 | A | * | 2/2016 | |
| KR | 102216801 | B1 | * | 2/2021 | H04R 3/04 |
| KR | 102363475 | B1 | * | 2/2022 | H04S 3/008 |
| WO | 2007096808 | A1 | | 8/2007 | |
| WO | 2015103024 | A1 | | 7/2015 | |
| WO | 2016077320 | A1 | | 5/2016 | |

OTHER PUBLICATIONS

Karapetyan et al., "Elevation Control in Binaural Rendering," AES 140th Convention, Paris, France, pp. 1-4 (Jun. 1-7, 2016).

Yao et al., "A Parametric Method for Elevation Control," International Workshop on Acoustic Signal Enhancement (IWAENC2018), Tokyo, Japan, pp. 181-185 (Sep. 2018).

* cited by examiner

AUDIO RENDERING METHOD AND APPARATUS

CROSS-REFERENCE TO RELATED APPLICATION

This application is a continuation of International Application No. PCT/CN2019/111620, filed on Oct. 17, 2019, which claims priority to Chinese Patent Application No. 201811261215.3, filed on Oct. 26, 2018. The disclosures of the aforementioned applications are hereby incorporated by reference in their entireties.

TECHNICAL FIELD

This application relates to the audio processing field, and in particular, to an audio rendering method and apparatus.

BACKGROUND

Three-dimensional audio is an audio processing technology that simulates a sound field of a real sound source in two ears to enable a listener to perceive that a sound comes from a sound source in three-dimensional space. A head related transfer function (HRTF) is an audio processing technology used to simulate conversion of an audio signal from a sound source to the eardrum in a free field, including impact imposed by the head, auricle, and shoulder on sound transmission. In an actual environment, a sound heard by the ear includes not only a sound that directly reaches the eardrum from a sound source, but also a sound that reaches the eardrum after being reflected by the environment. To simulate a complete sound, the conventional technology provides a binaural room impulse response (BRIR), to represent conversion of an audio signal from a sound source to the two ears in a room.

An existing BRIR rendering method is roughly as follows: A mono signal or a stereo signal is used as an input audio signal, a corresponding BRIR function is selected based on an azimuth of a virtual sound source, and the input audio signal is rendered according to the BRIR function to obtain a target audio signal.

However, in the existing BRIR rendering method, only impact of different azimuths on a same horizontal plane is considered, and an elevation angle of the virtual sound source is not considered. Consequently, a sound in the three-dimensional space cannot be accurately rendered.

SUMMARY

In view of this, this application provides a binaural audio processing method and audio processing apparatus, to accurately render an audio in three-dimensional space.

According to a first aspect, an audio rendering method is provided, including: obtaining a to-be-rendered BRIR signal, where an elevation angle corresponding to the to-be-rendered BRIR signal is 0 degrees; obtaining a direct sound signal based on the to-be-rendered BRIR signal; correcting, based on a target elevation angle, a frequency-domain signal corresponding to the direct sound signal, to obtain a frequency-domain signal corresponding to the target elevation angle; obtaining a time-domain signal based on the corrected frequency-domain signal; and superposing the time-domain signal on a signal that is in the to-be-rendered BRIR signal and that is in a second time period after a first time period, to obtain a BRIR signal of the target elevation angle. The direct sound signal corresponds to the first time period in a time period corresponding to the to-be-rendered BRIR signal.

According to this embodiment, because there is a correspondence between the target elevation angle and the time-domain signal that is obtained based on the corrected frequency-domain signal, and the signal in the second time period can reflect audio transformation caused by environmental reflection, a target BRIR signal synthesized by the signal in the second time period and the time-domain signal is a stereo BRIR signal.

In an embodiment, the correcting, based on a target elevation angle, a frequency-domain signal corresponding to the direct sound signal includes: determining a correction coefficient based on the target elevation angle and a correction function; and correcting, based on the correction coefficient, the frequency-domain signal corresponding to the direct sound signal, to obtain the corrected frequency-domain signal. The correction function includes a numerical relationship between coefficients of HRTF signals corresponding to different elevation angles.

According to this embodiment, the correction coefficient may be determined based on the target elevation angle and the correction function corresponding to the target elevation angle. The correction coefficient may be a vector including a group of coefficients. The correction coefficient is used to process the frequency-domain signal corresponding to the direct sound signal, so that an obtained corrected frequency-domain signal corresponds to the target elevation angle. Therefore, a method for correcting the frequency-domain signal corresponding to the direct sound is provided, so that the corrected frequency-domain signal can correspond to the target elevation angle.

In another embodiment, the correcting, based on a target elevation angle, a frequency-domain signal corresponding to the direct sound signal includes: correcting, based on the target elevation angle, at least one piece of information about a peak point or a valley point in a spectral envelope corresponding to the direct sound signal, to obtain at least one piece of corrected information about the peak point or the valley point, where the at least one piece of corrected information about the peak point or the valley point corresponds to the target elevation angle; determining a target filter based on the at least one piece of corrected information about the peak point or the valley point; and filtering the direct sound signal by using the target filter, to obtain the corrected frequency-domain signal.

According to this embodiment, a correction coefficient of the peak point in the spectral envelope may be determined based on the target elevation angle, and then at least one piece of information about the peak point is corrected by using the correction coefficient of the peak point. The at least one piece of information about the peak point includes a center frequency of the peak point, a bandwidth of the peak point, and a gain of the peak point. A peak point filter is determined based on at least one piece of corrected information about the peak point. In addition, a correction coefficient of the valley point in the spectral envelope may be determined based on the target elevation angle, and then at least one piece of information about the valley point is corrected by using the correction coefficient of the valley point. The at least one piece of information about the valley point includes but is not limited to a bandwidth of the valley point and a gain of the valley point. A valley point filter is determined based on at least one piece of corrected information about the valley point. The peak point filter and the valley point filter are cascaded to obtain the target filter.

Because both the peak point filter and the valley point filter correspond to the corrected information, there is also a correspondence between the target filter and the corrected information. The corrected information is related to the target elevation angle. Therefore, after the direct sound signal is filtered by using the target filter, the obtained corrected frequency-domain signal is related to the target elevation angle. Therefore, another method for obtaining the direct sound frequency-domain signal corresponding to the target elevation angle is provided.

In another embodiment, the obtaining a time-domain signal based on the corrected frequency-domain signal includes: determining an energy adjustment coefficient based on the target elevation angle and an energy adjustment function; adjusting the corrected frequency-domain signal based on the energy adjustment coefficient to obtain an adjusted frequency-domain signal; and performing frequency-time conversion on the adjusted frequency-domain signal to obtain the time-domain signal. The energy adjustment function includes a numerical relationship between frequency band energy of the HRTF signals corresponding to different elevation angles.

According to this embodiment, the energy adjustment coefficient may be determined based on the target elevation angle and the energy adjustment function. Because the energy adjustment function includes the numerical relationship between frequency band energy of the HRTF signals corresponding to different elevation angles, the energy adjustment coefficient can represent a difference between frequency band energy distributions of the signals. The corrected frequency-domain signal is adjusted based on the energy adjustment coefficient, to adjust a frequency band energy distribution of the corrected frequency-domain signal, so as to reduce a problem that a sound disappears at an eccentric ear valley point, and optimize a stereo effect.

In another embodiment, the obtaining a direct sound signal based on the to-be-rendered BRIR signal includes: extracting a signal in the first time period from the to-be-rendered BRIR signal, and processing the signal in the first time period by using a Hanning window, to obtain the direct sound signal. According to this embodiment, windowing processing is performed on the signal in the first time period by using the Hanning window, so that a truncation effect in a time-frequency conversion process can be eliminated, interference caused by trunk scattering can be reduced, and accuracy of the signal can be improved. In addition, a Hamming window may alternatively be used to perform windowing processing on the signal in the first time period.

In another embodiment, the obtaining a direct sound signal based on the to-be-rendered BRIR signal includes: extracting a signal in the first time period from the to-be-rendered BRIR signal, and processing the signal in the first time period by using a Hanning window, to obtain the direct sound signal. The obtaining a time-domain signal based on the corrected frequency-domain signal includes: superposing a spectrum of the corrected frequency-domain signal on a spectrum detail, and performing frequency-time conversion on a signal corresponding to a spectrum obtained through superposition, to obtain the time-domain signal. The spectrum detail is a difference between a spectrum of the signal in the first time period and a spectrum of the direct sound signal, and may represent an audio signal lost in a windowing process. According to this embodiment, the corrected frequency-domain signal is corrected by using the spectrum detail, to increase the audio signal lost in the windowing process, so as to better restore the BRIR signal and achieve a better simulation effect.

In another embodiment, the obtaining a direct sound signal based on the to-be-rendered BRIR signal includes: extracting a signal in the first time period from the to-be-rendered BRIR signal, and processing the signal in the first time period by using a Hanning window, to obtain the direct sound signal.

The obtaining a time-domain signal based on the corrected frequency-domain signal includes: superposing a spectrum of the corrected frequency-domain signal on a spectrum detail, where the spectrum detail is a difference between a spectrum of the signal in the first time period and a spectrum of the direct sound signal; determining an energy adjustment coefficient based on the target elevation angle and an energy adjustment function; adjusting, based on the energy adjustment coefficient, a signal corresponding to a spectrum obtained through superposition, to obtain an adjusted frequency-domain signal; and performing frequency-time conversion on the adjusted frequency-domain signal to obtain the time-domain signal. The energy adjustment function includes a numerical relationship between frequency band energy of the HRTF signals corresponding to different elevation angles.

According to this embodiment, after the spectrum detail is superposed on the spectrum of the corrected frequency-domain signal, the signal corresponding to the spectrum obtained through is adjusted by using the energy adjustment coefficient, so that a frequency band energy distribution of the signal corresponding to the spectrum obtained through superposition can be adjusted, and a stereo effect can be optimized.

According to a second aspect, an audio rendering method is provided, including: obtaining a to-be-rendered BRIR signal, where an elevation angle corresponding to the to-be-rendered BRIR signal is 0 degrees; correcting, based on a target elevation angle, a frequency-domain signal corresponding to the to-be-rendered BRIR signal; and performing frequency-time conversion on a corrected frequency-domain signal to obtain a BRIR signal of the target elevation angle. According to this embodiment, the frequency-domain signal corresponding to the to-be-rendered BRIR signal is corrected based on the target elevation angle, so that the BRIR signal corresponding to the target elevation angle can be obtained. Therefore, a method for implementing a stereo BRIR signal is provided.

In another embodiment, the correcting, based on a target elevation angle, a frequency-domain signal corresponding to the to-be-rendered BRIR signal includes: determining a correction coefficient based on the target elevation angle and a correction function; and processing, by using the correction coefficient, the frequency-domain signal corresponding to the to-be-rendered BRIR signal, to obtain the corrected frequency-domain signal. The correction function includes a numerical correspondence between spectrums of HRTF signals corresponding to different elevation angles. According to this embodiment, the correction coefficient may be determined based on the target elevation angle and the correction function corresponding to the target elevation angle. The correction coefficient may be a vector including a group of coefficients, and each coefficient corresponds to one frequency-domain signal point. The correction coefficient is used to process the frequency-domain signal corresponding to the to-be-rendered BRIR signal, so that an obtained corrected frequency-domain signal corresponds to the target elevation angle. Therefore, a method for correcting the to-be-rendered BRIR signal is provided, so that the corrected frequency-domain signal can correspond to the target elevation angle.

According to a third aspect, an audio rendering method is provided, including: obtaining a to-be-rendered BRIR signal, where an elevation angle corresponding to the to-be-rendered BRIR signal is 0 degrees; obtaining an HRTF spectrum corresponding to a target elevation angle; and correcting the to-be-rendered BRIR signal based on the HRTF spectrum corresponding to the target elevation angle, to obtain a BRIR signal of the target elevation angle. According to this embodiment, a correction coefficient may be determined based on the HRTF spectrum corresponding to the target elevation angle. The correction coefficient is used to process a frequency-domain signal corresponding to the to-be-rendered BRIR signal, so that an obtained corrected frequency-domain signal corresponds to the target elevation angle. Therefore, another method for obtaining a stereo BRIR signal is provided.

According to a fourth aspect, an audio rendering apparatus is provided. The audio rendering apparatus may include an entity such as a terminal device or a chip, and the audio rendering apparatus includes a processor and a memory. The memory is configured to store instructions, and the processor is configured to execute the instructions in the memory, to enable the audio rendering apparatus to perform the method according to any one of the first aspect, the second aspect, or the third aspect.

According to a fifth aspect, a computer-readable storage medium is provided. The computer-readable storage medium stores instructions, and when the instructions are run on a computer, the computer is enabled to perform the method according to the foregoing aspects.

According to a sixth aspect, a computer program product including instructions is provided. When the computer program product runs on a computer, the computer is enabled to perform the method according to the foregoing aspects.

DESCRIPTION OF EMBODIMENTS

Figure 1:
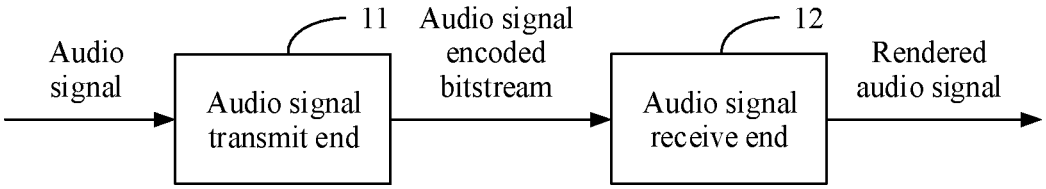
FIG. 1 is a schematic structural diagram of an audio signal system according to this application.

FIG. 1 is a schematic structural diagram of an audio signal system according to an embodiment of this application. The audio signal system includes an audio signal transmit end 11 and an audio signal receive end 12.

The audio signal transmit end 11 is configured to collect and encode a signal sent by a sound source, to obtain an audio signal encoded bitstream. After obtaining the audio signal encoded bitstream, the audio signal receive end 12 decodes the audio signal encoded bitstream, to obtain a decoded audio signal; and then renders the decoded audio signal to obtain a rendered audio signal.

Optionally, the audio signal transmit end 11 may be connected to the audio signal receive end 12 in a wired or wireless manner.

Figure 2:
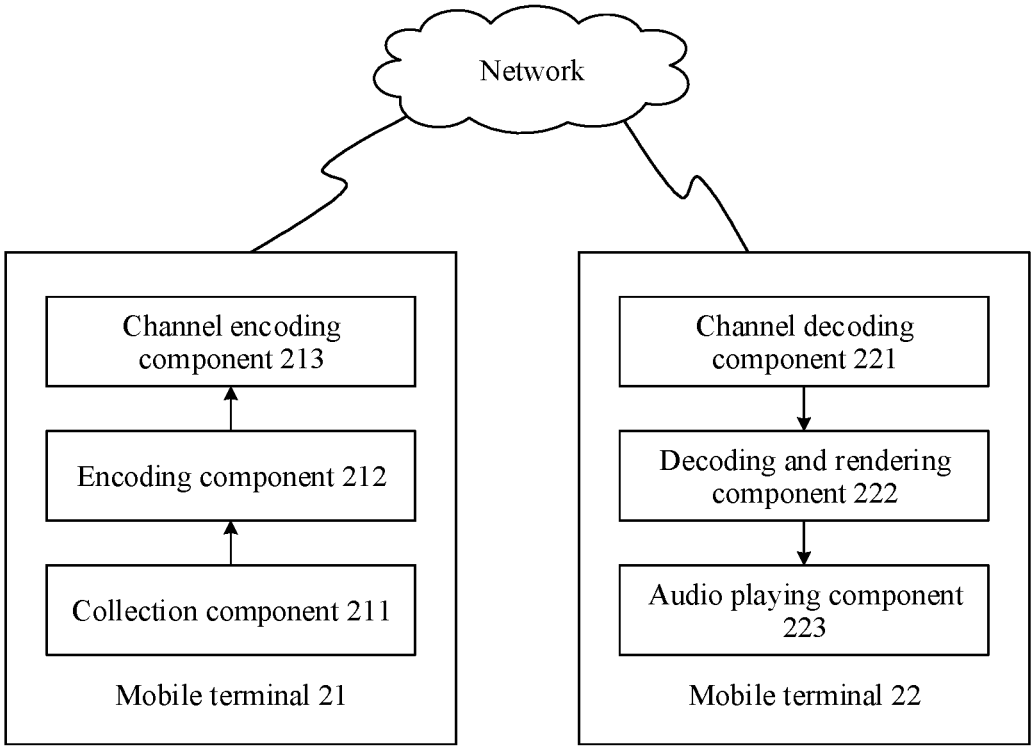
FIG. 2 is a schematic diagram of a system architecture according to this application.

FIG. 2 is a diagram of a system architecture according to an embodiment of this application. As shown in FIG. 2, the system architecture includes a mobile terminal 21 and a mobile terminal 22. The mobile terminal 21 may be an audio signal transmit end, and the mobile terminal 22 may be an audio signal receive end.

The mobile terminal 21 and the mobile terminal 22 may be electronic devices that are independent of each other and that have an audio signal processing capability. For example, the mobile terminal 21 and the mobile terminal 22 may be mobile phones, wearable devices, virtual reality (VR) devices, augmented reality (AR) devices, personal computers, tablet computers, vehicle-mounted computers, wearable electronic devices, theater acoustic devices, home theater devices, or the like. In addition, the mobile terminal 21 and the mobile terminal 22 are connected to each other through a wireless or wired network.

Optionally, the mobile terminal 21 may include a collection component 211, an encoding component 212, and a channel encoding component 213. The collection component 211 is connected to the encoding component 212, and the encoding component 212 is connected to the channel encoding component 213.

Optionally, the mobile terminal 22 may include a channel decoding component 221, a decoding and rendering component 222, and an audio playing component 223. The decoding and rendering component 222 is connected to the channel decoding component 221, and the audio playing component 223 is connected to the decoding and rendering component 222.

After collecting an audio signal through the collection component 211, the mobile terminal 21 encodes the audio signal through the encoding component 212, to obtain an audio signal encoded bitstream; and then encodes the audio signal encoded bitstream through the channel encoding component 213, to obtain a transmission signal.

The mobile terminal 21 sends the transmission signal to the mobile terminal 22 through the wireless or wired network.

After receiving the transmission signal, the mobile terminal 22 decodes the transmission signal through the channel decoding component 221, to obtain the audio signal encoded bitstream. Through the decoding and rendering component 222, the mobile terminal 22 decodes the audio signal encoded bitstream, to obtain a to-be-processed audio signal, and renders the to-be-processed audio signal, to obtain a rendered audio signal. Then, the mobile terminal 22 plays the rendered audio signal through the audio playing component 223. It may be understood that the mobile terminal 21 may alternatively include the components included in the mobile terminal 22, and the mobile terminal 22 may alternatively include the components included in the mobile terminal 21.

In addition, the mobile terminal 22 may alternatively include an audio playing component, a decoding component, a rendering component, and a channel decoding component. The channel decoding component is connected to the decoding component, the decoding component is connected to the rendering component, and the rendering component is connected to the audio playing component. In this case, after receiving the transmission signal, the mobile terminal 22 decodes the transmission signal through the channel decoding component, to obtain the audio signal encoded bitstream; decodes the audio signal encoded bitstream through the decoding component, to obtain a to-be-processed audio signal; renders the to-be-processed audio signal through the rendering component, to obtain a rendered audio signal; and plays the rendered audio signal through the audio playing component.

In a conventional technology, a BRIR function includes an azimuth parameter. A mono signal or stereo signal is used as an audio test signal, and then the BRIR function is used to process the audio test signal to obtain a BRIR signal. The BRIR signal may be a convolution of the audio test signal and the BRIR function, and azimuth information of the BRIR signal depends on an azimuth parameter value of the BRIR function.

In an implementation, a range of an azimuth on a horizontal plane is [0, 360°]. A head reference point is used as an origin, an azimuth corresponding to the middle of the face is 0 degrees, an azimuth of the right ear is 90 degrees, and an azimuth of the left ear is 270 degrees. When an azimuth of a virtual sound source is 90 degrees, an input audio signal is rendered according to a BRIR function corresponding to 90 degrees, and then a rendered audio signal is output. For a user, the rendered audio signal is like a sound emitted from a sound source in a right horizontal direction. Because an existing BRIR signal includes azimuth information, the BRIR signal can represent a room pulse response in a horizontal direction. However, the existing BRIR signal does not include an elevation angle parameter. It may be considered that an elevation angle of the existing BRIR signal is 0 degrees, and the existing BRIR signal cannot represent a room impulse response in a vertical direction. Therefore, a sound in three-dimensional space cannot be accurately rendered.

To resolve the foregoing problem, this application provides an audio rendering method, to render a stereo BRIR signal.

Figure 3:
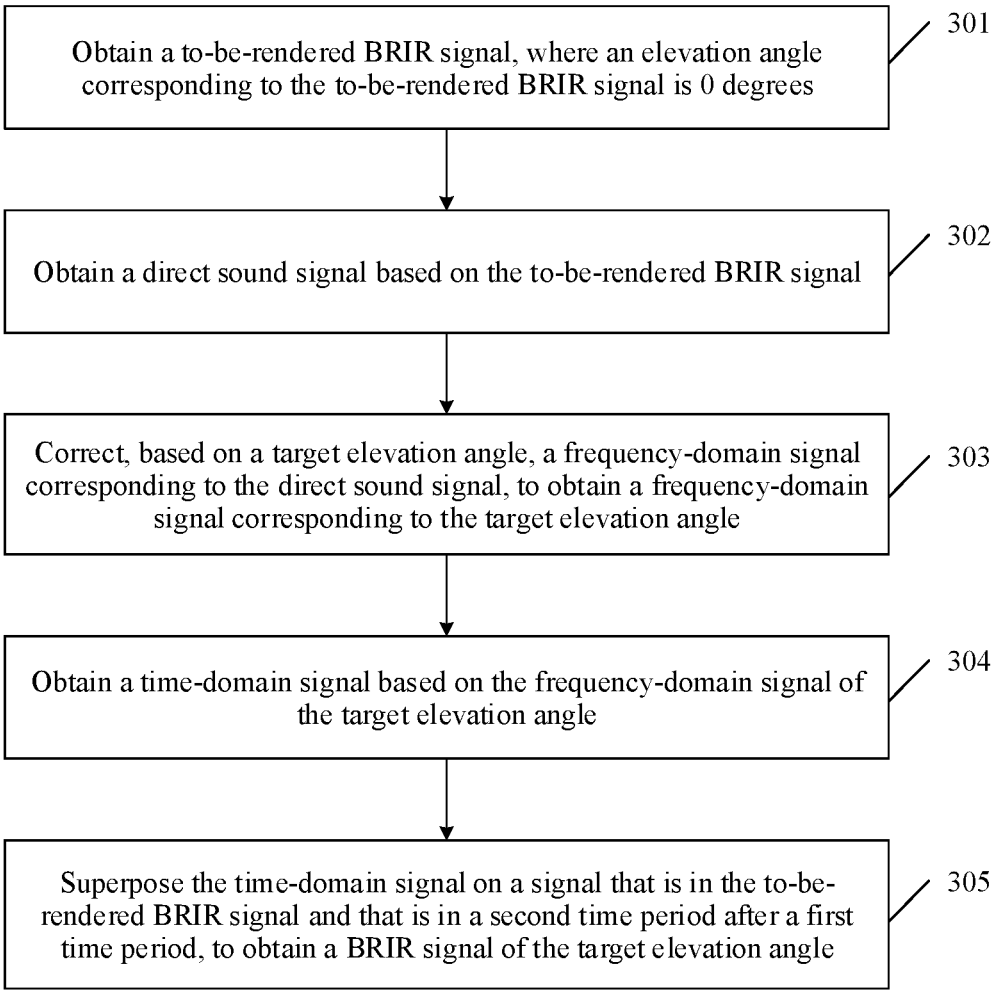
FIG. 3 is a schematic flowchart of an audio rendering method according to this application.

Referring to FIG. 3, an embodiment of the audio rendering method provided in this application includes the following steps.

Step 301: Obtain a to-be-rendered BRIR signal, where an elevation angle corresponding to the to-be-rendered BRIR signal is 0 degrees.

In this embodiment, the to-be-rendered BRIR signal is a sampling signal. For example, if a sampling frequency is 44.1 kHz, 88 time-domain signal points may be obtained through sampling within 2 ms and used as the to-be-rendered BRIR signal.

Step 302: Obtain a direct sound signal based on the to-be-rendered BRIR signal.

The direct sound signal corresponds to a first time period in a time period corresponding to the to-be-rendered BRIR signal. A signal in the first time period refers to a signal part in the to-be-rendered BRIR signal from a start time to an $m^{th}$ millisecond, where m may be but is not limited to a value in [1, 20]. For example, in the to-be-rendered BRIR signal, the signal in the first time period is an audio signal in a first 2 ms. The signal in the first time period may be denoted as brir_1(n), and a frequency-domain signal obtained by converting the signal in the first time period may be denoted as brir_1(f).

Step 303: Correct, based on a target elevation angle, a frequency-domain signal corresponding to the direct sound signal, to obtain a frequency-domain signal corresponding to the target elevation angle.

The target elevation angle refers to an included angle between a horizontal plane and a straight line from a virtual sound source to a head reference point, and the head reference point may be a midpoint between two ears. A value of the target elevation angle is selected according to an actual application, and may be any value in [−90°, 90°]. The value of the target elevation angle may be input by a user, or may be preset in an audio rendering apparatus and locally invoked by the audio rendering apparatus.

Step 304: Obtain a time-domain signal based on the frequency-domain signal of the target elevation angle.

After the frequency-domain signal corresponding to the target elevation angle is obtained, time-frequency conversion may be performed on the frequency-domain signal to obtain the time-domain signal.

When discrete Fourier transform (DFT) is used to perform time-frequency conversion, inverse discrete Fourier transform (IDFT) is used to perform inverse time-frequency conversion. When fast Fourier transform (FFT) is used to perform time-frequency conversion, inverse fast Fourier transform (IFFT) is used to perform inverse time-frequency conversion. It may be understood that a time-frequency conversion method in this application is not limited to the foregoing examples.

Step 305: Superpose the time-domain signal on a signal that is in the to-be-rendered BRIR signal and that is in a second time period after the first time period, to obtain a BRIR signal of the target elevation angle.

A time period corresponding to the time-domain signal is the first time period, and the time-domain signal and the signal that is in the to-be-rendered BRIR signal and that is the second time period are synthesized into the BRIR signal of the target elevation angle. When an audio rendering device outputs the BRIR signal of the target elevation angle, a sound heard by a user is similar to a sound emitted from a sound source at a position of the target elevation angle, and has a good simulation effect.

In this embodiment, because there is a correspondence between the target elevation angle and the time-domain signal that is obtained based on the corrected frequency-domain signal, and the signal in the second time period can reflect audio transformation caused by environmental reflection, the BRIR signal synthesized by the signal in the second time period and the time-domain signal is a stereo BRIR signal.

In an optional embodiment, step 303 includes: determining a correction coefficient based on the target elevation angle and a correction function; and processing, by using the correction coefficient, the frequency-domain signal corresponding to the direct sound signal, to obtain the corrected frequency-domain signal.

In this embodiment, there is a correspondence between the target elevation angle and the correction function. For example, an elevation angle is in a one-to-one correspondence with a correction function. Alternatively, an elevation angle range is in a one-to-one correspondence with a correction function. For example, each elevation angle range has an equal size, and the size of each elevation angle range may be but is not limited to: 5 degrees, 10 degrees, 20 degrees, or 30 degrees.

The correction function includes a numerical relationship between coefficients of HRTF signals corresponding to different elevation angles. The correction function may be obtained based on spectrums of the HRTF signals corresponding to different elevation angles. For example, a first HRTF signal and a second HRTF signal have a same azimuth, but have different elevation angles. A difference between the elevation angles of the two signals is the target elevation angle. The correction function of the target elevation angle may be determined based on a spectrum of the first HRTF signal and a spectrum of the second HRTF signal. The correction coefficient is determined based on the target elevation angle and the correction function. The correction coefficient may be a vector including a group of coefficients, and each frequency-domain signal point has a corresponding coefficient.

The frequency-domain signal corresponding to the direct sound signal is processed by using the correction coefficient, to obtain the corrected frequency-domain signal. The correction coefficient, the frequency-domain signal corresponding to the direct sound signal, and the corrected frequency-domain signal meet the following correspondence:

$$brir_3(f)=brir_2(f)*p(f).$$

brir_2(f) is an amplitude of a frequency-domain signal point whose frequency is f in the frequency-domain signal corresponding to the direct sound signal. brir_3(f) is an amplitude of a frequency-domain signal point whose frequency is fin the corrected frequency-domain signal. p(f) is a correction coefficient corresponding to the frequency-domain signal point whose frequency is f. A value range off may be but is not limited to [0, 20000 Hz].

When an elevation angle is 45 degrees, p(f) corresponding to 45 degrees is shown as follows:

$$\text{when } 0\leq f\leq 8000, p(f)=2.0+10^{-7}\times(f-4500)^2;$$

$$\text{when } 8001 f\leq 13000, p(f)=2.8254+10^{-7}\times(f-10000)^2; \text{ or}$$

$$\text{when } 13001\leq f<20000, p(f)=4.6254-10^{-7}\times(f-16000)^2.$$

This embodiment provides a method for adjusting the direct sound signal. Because a time-domain signal obtained through adjustment corresponds to the target elevation angle, and the signal in the second time period can reflect audio transformation caused by environmental reflection, a target BRIR signal obtained by superposing the signal in the second time period and the time-domain signal is a stereo BRIR signal.

In another optional embodiment, step 303 includes: correcting, based on the target elevation angle, at least one piece of information about a peak point and information about a valley point in a spectral envelope corresponding to the direct sound signal, to obtain at least one piece of corrected information about the peak point and the valley point, where the at least one piece of corrected information about the peak point and the valley point corresponds to the target elevation angle; determining a target filter based on the at least one piece of corrected information about the peak point and the valley point; and filtering the direct sound signal by using the target filter, to obtain the corrected frequency-domain signal.

In this embodiment, one or more peak points and one or more valley points exist in the spectral envelope corresponding to the direct sound signal, and at least one piece of information about the peak point includes but is not limited to a center frequency of the peak point, a bandwidth of the peak point, and a gain of the peak point. At least one piece of information about the valley point includes but is not limited to a bandwidth of the valley point and a gain of the valley point.

One elevation angle corresponds to one group of weights, and each weight in the group corresponds to one piece of information. For example, a group of weights corresponding to the center frequency, the bandwidth, and the gain of the peak point include a center frequency weight, a bandwidth weight, and a gain weight. A group of weights corresponding to the bandwidth and gain of the valley point includes a bandwidth weight and a gain weight.

For example, a center frequency weight, a bandwidth weight, and a gain weight of a first peak point are respectively denoted as $(q_1,q_2,q_3)$.

A corrected center frequency $f'_{C_{P1}}$ of the first peak point and a center frequency $f_{C_{P1}}$ of the first peak point meet the following correspondence:

$$f'_{C_{P1}}=q_1*f_{C_{P1}}.$$

A value of $q_1$ may be but is not limited to any value in [1.4, 1.6], for example, 1.5.

A corrected bandwidth $f'_{B_{P1}}$ of the first peak point and a bandwidth $f_{B_{P1}}$ of the first peak point meet the following correspondence: $f'_{B_{P1}}=q_2*f_{B_{P1}}$.

A value of $q_2$ may be but is not limited to any value in [1.1, 1.3], for example, 1.2.

A corrected gain $G'_{P1}$ of the first peak point and a gain $G_{P1}$ of the first peak point meet the following correspondence:

$$G'_{P1}=q_3*G_{P1}.$$

A value of $q_3$ may be but is not limited to any value in [1.2, 1.4], for example, 1.3.

A filter of the first peak point is determined based on $f'_{C_{P1}}$, $f_{B_{P1}}$, and $G'_{P1}$, and a formula of the filter of the first peak point is as follows:

$$H_{peak}(z)=\frac{V_o(1-h)(1-z^{-2})}{1+2d*h*z^{-1}+(2h-1)z^{-2}}, \text{ where}$$

$$h=\frac{1}{1+\tan\left(\pi*\frac{f'_{B_{P1}}}{f_s}\right)},$$

$$d=-\cos\left(2\pi*\frac{f'_{C_{P1}}}{f'_{B_{P1}}}\right), \text{ and}$$

$$V_0=10^{\frac{G'_{P1}}{20}}.$$

$f_S$ is a sampling frequency, and Z represents a Z field.

For a first valley point, a bandwidth weight and a gain weight of the first valley point are respectively $(q_4,q_5)$.

A corrected bandwidth $f'_{B_{N1}}$ of the first valley point and a bandwidth $f_{B_{N1}}$ of the first valley point meet the following correspondence:

$$f'_{B_{N1}}=q_4*f_{B_{N1}}.$$

A value of $q_4$ may be but is not limited to any value in [1.1, 1.3], for example, 1.2.

Corrected gains $G'_{N1}$ and $G_{N1}$ of the first valley point meets the following correspondence:

$$G'_{N1}=q_5*G_{N1}.$$

A value of $q_5$ may be but is not limited to any value in [1.2, 1.4], for example, 1.3.

A filter of the first valley point is determined based on $f'_{B_{N1}}$ and $G_{N1}$, and a formula of the filter of the first valley point is as follows:

$$H_{notch}(z)=\frac{1+(1+k)\frac{H_0}{2}+d(1-k)z^{-1}+\left(-k-(1+k)\frac{H_0}{2}\right)z^{-2}}{1+d(1-k)z^{-1}-kz^{-2}}, \text{ where}$$

$$H_0=V_1-1,$$

$$V_1=10^{\frac{G'_{N1}}{20}}, \text{ and}$$

$$k=\frac{\tan\left(\pi*\frac{f'_{B_{N1}}}{f_s}\right)-V_1}{\tan\left(\pi*\frac{f'_{B_{N1}}}{f_s}\right)+V_1}.$$

The filter of the first peak point and the filter of the first valley point are connected in series to obtain the target filter, and then the target filter is used to filter the direct sound signal to obtain the corrected frequency-domain signal.

It should be noted that a plurality of peak points and a plurality of valley points may alternatively be selected. Then, a peak point filter corresponding to each peak point is determined based on corrected information of each peak point, and a valley point filter corresponding to each valley point is determined based on corrected information of each valley point. Next, a plurality of determined peak point filters and a plurality of determined valley point filters are cascaded to obtain the target filter. Cascading the plurality of peak point filters and the plurality of valley point filters may be: connecting the plurality of peak point filters in parallel, and then connecting the plurality of parallel peak point filters and the plurality of valley point filters in series.

In this embodiment, because both the peak point filter and the valley point filter correspond to the corrected information, there is also a correspondence between the target filter and the corrected information. The corrected information is related to the target elevation angle. Therefore, after the direct sound signal is filtered by using the target filter, the obtained corrected frequency-domain signal is related to the target elevation angle. Therefore, another method for obtaining the direct sound frequency-domain signal corresponding to the target elevation angle is provided.

In another optional embodiment, step 304 includes: determining an energy adjustment coefficient based on the target elevation angle and an energy adjustment function; adjusting the corrected frequency-domain signal based on the energy adjustment coefficient to obtain an adjusted frequency-domain signal; and performing frequency-time conversion on the adjusted frequency-domain signal to obtain the time-domain signal.

In this embodiment, the energy adjustment function includes a numerical relationship between frequency band energy of the HRTF signals corresponding to different elevation angles. The energy adjustment coefficient may be determined based on the target elevation angle and the energy adjustment function, and the corrected frequency-domain signal may be adjusted based on the energy adjustment coefficient. A correspondence between a spectrum of the adjusted frequency-domain signal, the energy adjustment function, and a spectrum of the corrected frequency-domain signal is as follows:

$$F(\omega)=\text{brir_3}(\omega)*M_0^{E(\theta)}, \text{ where}$$

$$E(\theta)=q_6*\theta.$$

$F(\omega)$ is the spectrum of the adjusted frequency-domain signal, brir_3(ω) is the spectrum of the corrected frequency-domain signal, and $M_0^{E(\theta)}$ is the energy adjustment function. A value range of $q_6$ is [1, 2], and a value range of θ is $$\left[-\frac{\pi}{2}, \frac{\pi}{2}\right].$$

ω is a spectrum parameter, and a correspondence between ω and a frequency parameter f is:

$$\omega=2\pi*f.$$

$M_0$ meets the following formula:

$$\text{when } 0\leq f\leq 9000, M_0=11.5+10^{-4}\times f;$$

$$\text{when } 9001\leq f\leq 12000, M_0=12.7+10^{-7}\times(f-9000)^2;$$

$$\text{when } 12001\leq f\leq 17000, M_0=15.1992-10^{-7}\times(f-16000)^2;$$

or $$\text{when } 17001\leq f\leq 20000, M_0=15.1990-10^{-7}\times(f-18000)^2.$$

In this embodiment, because the energy adjustment function includes the numerical relationship between frequency band energy of the HRTF signals corresponding to different elevation angles, the energy adjustment coefficient can represent a difference between frequency band energy distributions of the signals. The corrected frequency-domain signal is adjusted based on the energy adjustment coefficient, to adjust a frequency band energy distribution of the corrected frequency-domain signal, reduce a problem that a sound disappears at an eccentric ear valley point, and optimize a stereo effect.

In another optional embodiment, step 302 includes: extracting the signal in the first time period from the to-be-rendered BRIR signal, and processing the signal in the first time period by using a Hanning window, to obtain the direct sound signal.

In this embodiment, in time domain, a relationship between the direct sound signal, the signal in the first period, and a Hanning window function may be expressed by using the following formula:

$$\text{brir_2}(n) = \text{brir_1}(n) * w(n), \text{ where}$$

$$w(n) = 0.5 * \left(1 - \cos\left(\frac{2*\pi*n}{N-1}\right)\right).$$

brir_1(n) represents an amplitude of an $n^{th}$ time-domain signal point in the signal in the first period, brir_2(n) represents an amplitude of an $n^{th}$ time-domain signal point in the direct sound signal, and w(n) represents a weight corresponding to the $n^{th}$ time-domain signal point in the Hanning window function. $n\in[0, N-1]$, and N is a total quantity of time-domain signal points in the signal in the first period or in the direct sound signal.

It may be understood that a function of windowing is to eliminate a truncation effect in a time-frequency conversion process, reduce interference caused by trunk scattering, and improve accuracy of the signal. In addition to using the Hanning window to process the signal in the first time period, another window, for example, a Hamming window, may alternatively be used to process the signal in the first time period.

In another optional embodiment, step 302 includes: extracting the signal in the first time period from the to-be-rendered BRIR signal, and processing the signal in the first time period by using a Hanning window, to obtain the direct sound signal.

Step 304 includes: superposing a spectrum of the corrected frequency-domain signal on a spectrum detail, where the spectrum detail is a difference between a spectrum of the signal in the first time period and a spectrum of the direct sound signal; and performing frequency-time conversion on a signal corresponding to a spectrum obtained through superposition, to obtain the time-domain signal.

For noun explanations, specific implementations, and technical effects in step 302, refer to corresponding descriptions in the previous embodiment.

Because the spectrum detail is the difference between the spectrum of the signal in the first time period and the spectrum of the direct sound signal, the spectrum detail may be used to represent an audio signal lost in a windowing process. For example, a correspondence between the spectrum detail, the spectrum of the direct sound signal, and the spectrum of the signal in the first time period may be as follows:

$$D(\omega)=\text{brir_2}(\omega)-\text{brir_1}(\omega).$$

D(ω)s the spectrum detail, brir_2(ω) is the spectrum of the direct sound signal, and brir_1(ω) is the spectrum of the signal in the first period.

The spectrum of the corrected frequency-domain signal is superposed on the spectrum detail. A superposing correspondence between the spectrum obtained through superposition, the spectrum of the corrected frequency-domain signal, and the spectrum detail may be as follows:

$$S(\omega)=\text{brir_3}(\omega)+D(\omega).$$

S(ω) is the spectrum obtained through superposition, and brir_3(ω) is the spectrum of the corrected frequency-domain signal.

It may be understood that, alternatively, the spectrum of the corrected frequency-domain signal may be weighted by using a first weight value, the spectrum detail is weighted by using a second weight value, and then the weighted spectrum information is superposed.

In this embodiment, after the frequency-domain signal corresponding to the direct sound signal is corrected, the corrected frequency-domain signal is superposed on the spectrum detail, to increase a lost audio signal, so as to better restore the BRIR signal and achieve a better simulation effect.

In another optional embodiment, step 302 includes: extracting the signal in the first time period from the to-be-rendered BRIR signal, and processing the signal in the first time period by using a Hanning window, to obtain the direct sound signal.

Step 304 includes: superposing a spectrum of the corrected frequency-domain signal on a spectrum detail, where the spectrum detail is a difference between a spectrum of the signal in the first time period and a spectrum of the direct sound signal; determining an energy adjustment coefficient based on the target elevation angle and an energy adjustment function, where the energy adjustment function includes a numerical relationship between frequency band energy of the HRTF signals corresponding to different elevation angles; adjusting, based on the energy adjustment coefficient, a signal corresponding to a spectrum obtained through superposition, to obtain an adjusted frequency-domain signal; and performing frequency-time conversion on the adjusted frequency-domain signal to obtain the time-domain signal.

For noun explanations, specific implementations, and technical effects in step 302, refer to corresponding descriptions in the foregoing embodiments.

The spectrum of the corrected frequency-domain signal is superposed on the spectrum detail. A correspondence between the spectrum obtained through superposition, the spectrum of the corrected frequency-domain signal, and the superposed spectrum detail may be as follows:

$$S(\omega)=\text{brir_3}(\omega)+D(\omega).$$

S(ω) is the spectrum obtained through superposition brir_3(ω) is the spectrum of the corrected frequency-domain signal, and D(ω) is the spectrum detail.

The signal corresponding to the spectrum obtained through superposition is adjusted based on the energy adjustment coefficient. A correspondence between a spectrum of the adjusted frequency-domain signal, the energy adjustment function, and the spectrum obtained through superposition is as follows:

$$F(\omega)=S(\omega)*M_0^{E(\theta)}, \text{ where}$$

$$E(\theta)=q_6*\theta.$$

F(ω) is the spectrum of the adjusted frequency-domain signal, and $M_0^{E(\theta)}$ is the energy adjustment function. A value range of $q_6$ is [1, 2], and a value range of θ is $$\left[-\frac{\pi}{2}, \frac{\pi}{2}\right].$$

For $M_0$, refer to corresponding descriptions in the foregoing embodiments.

Figure 4:
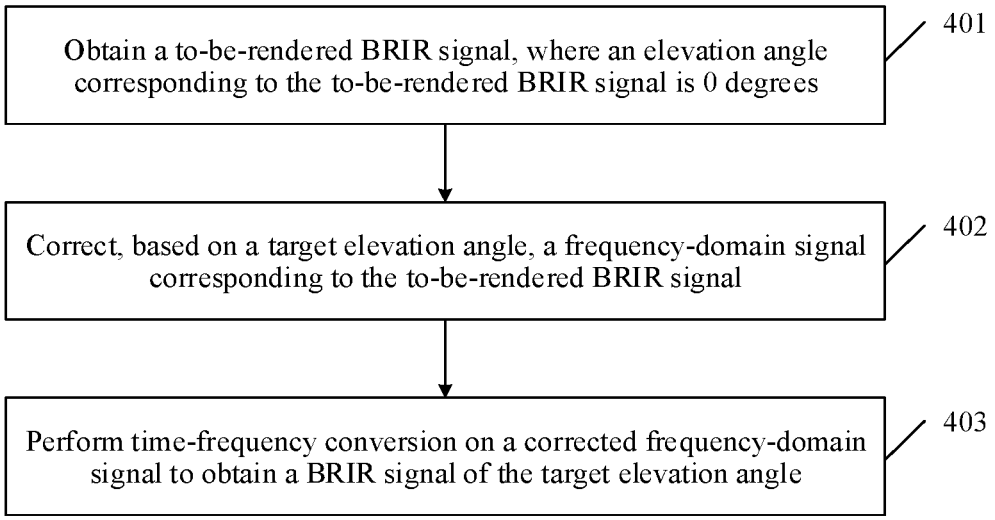
FIG. 4 is another schematic flowchart of an audio rendering method according to this application.

Referring to FIG. 4, another embodiment of the audio rendering method provided in this application includes the following steps.

Step 401: Obtain a to-be-rendered BRIR signal, where an elevation angle corresponding to the to-be-rendered BRIR signal is 0 degrees.

Step 402: Correct, based on a target elevation angle, a frequency-domain signal corresponding to the to-be-rendered BRIR signal.

Step 403: Perform time-frequency conversion on a corrected frequency-domain signal to obtain a BRIR signal of the target elevation angle.

In this embodiment, a method for obtaining the BRIR signal corresponding to the target elevation angle is provided. The method has advantages of low calculation complexity and a fast execution speed.

In an optional embodiment, step 402 includes: determining a correction coefficient based on the target elevation angle and a correction function, where the correction function includes a numerical correspondence between spectrums of HRTF signals corresponding to different elevation angles; and processing, by using the correction coefficient, the frequency-domain signal corresponding to the to-be-rendered BRIR signal, to obtain the corrected frequency-domain signal.

In this embodiment, the correction coefficient may be a vector including a group of coefficients, and each coefficient corresponds to one frequency-domain signal point. A correction coefficient whose frequency is f is denoted as H(f). A correspondence between the corrected frequency-domain signal, the correction coefficient, and the frequency-domain signal corresponding to the to-be-rendered BRIR signal is as follows:

$$\text{brir_}pro(f)=H(f)*\text{brir}(f).$$

brir_pro)(f) is an amplitude of a frequency-domain reference point whose frequency is f in the corrected frequency-domain signal. brir(f) is an amplitude of a frequency-domain reference point whose frequency is f in the frequency-domain signal corresponding to the to-be-rendered BRIR signal. A value range off may be but is not limited to [0, 20000 Hz]. For example, when an elevation angle is 45 degrees, H(f) corresponding to 45 degrees meets the following formula:

$$\text{when } 0\le f\le 9000, H(f)=12+10^{-4}\times f;$$

$$\text{when } 9001\le f\le 12000, H(f)=13.2+10^{-7}\times(f-9000)^2;$$

$$\text{when } 12001\le f\le 17000, H(f)=15.6992-10^{-7}\times(f-16000)^2; \text{ or}$$

$$\text{when } 17001\le f\le 20000, H(f)=15.6990-10^{-7}\times(f-18000)^2.$$

In this embodiment, the correction coefficient may be determined based on the target elevation angle and the correction function corresponding to the target elevation angle. The correction coefficient is used to process the frequency-domain signal corresponding to the to-be-rendered BRIR signal, so that an obtained corrected frequency-domain signal corresponds to the target elevation angle. Therefore, a method for correcting the to-be-rendered BRIR signal is provided, so that the corrected frequency-domain signal can correspond to the target elevation angle.

Figure 5:
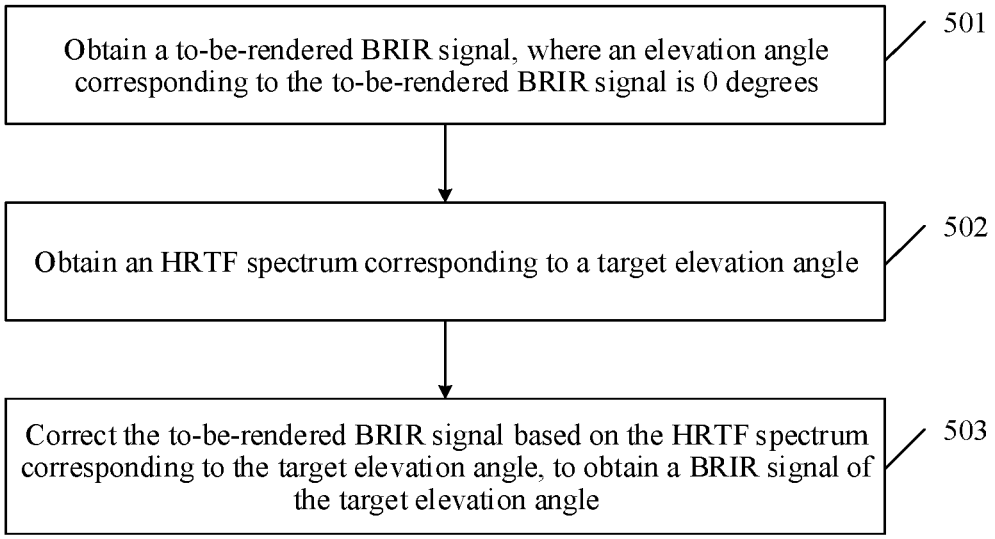
FIG. 5 is another schematic flowchart of an audio rendering method according to this application.

Referring to FIG. 5, an embodiment of the audio rendering method provided in this application includes the following steps.

Step 501: Obtain a to-be-rendered BRIR signal, where an elevation angle corresponding to the to-be-rendered BRIR signal is 0 degrees.

Step 502: Obtain an HRTF spectrum corresponding to a target elevation angle.

Step 503: Correct the to-be-rendered BRIR signal based on the HRTF spectrum corresponding to the target elevation angle, to obtain a BRIR signal of the target elevation angle.

Optionally, step 503 is: determining a correction coefficient based on a spectrum of a first HRTF signal and a spectrum of a second HRTF signal; and correcting the to-be-rendered BRIR signal based on the correction coefficient. The first HRTF signal and the second HRTF signal have a same azimuth, but have different elevation angles. A difference between the elevation angles of the two signals is the target elevation angle. The correction coefficient may be determined based on the spectrum of the first HRTF signal and the spectrum of the second HRTF signal.

The correction coefficient may be a vector including a group of coefficients, and each frequency-domain signal point has a corresponding coefficient. A correction coefficient whose frequency is f is denoted as H(f). For a corrected frequency-domain signal, a correction function, and a frequency-domain signal corresponding to the to-be-rendered BRIR signal, refer to corresponding descriptions in the foregoing embodiments.

In this embodiment, the correction coefficient may be determined based on the HRTF spectrum corresponding to the target elevation angle. The correction coefficient is used to process the frequency-domain signal corresponding to the to-be-rendered BRIR signal, so that an obtained corrected frequency-domain signal corresponds to the target elevation angle. Therefore, another method for obtaining a stereo BRIR signal is provided.

Figure 6:
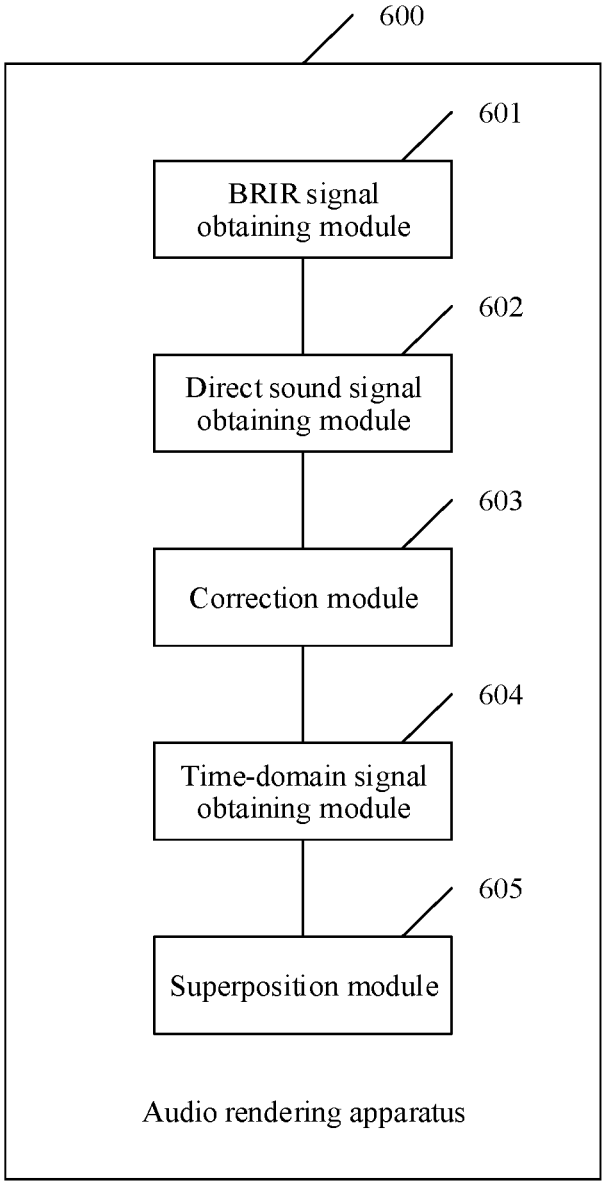
FIG. 6 is a schematic diagram of an audio rendering apparatus according to this application.

Referring to FIG. 6, an embodiment of an audio rendering apparatus 600 provided in this application includes:

a BRIR signal obtaining module 601, configured to obtain a to-be-rendered BRIR signal, where an elevation angle corresponding to the to-be-rendered BRIR signal is 0 degrees;

a direct sound signal obtaining module 602, configured to obtain a direct sound signal based on the to-be-rendered BRIR signal, where the direct sound signal corresponds to a first time period in a time period corresponding to the to-be-rendered BRIR signal;

a correction module 603, configured to correct, based on a target elevation angle, a frequency-domain signal corresponding to the direct sound signal, to obtain a frequency-domain signal corresponding to the target elevation angle;

a time-domain signal obtaining module 604, configured to obtain a time-domain signal based on the frequency-domain signal of the target elevation angle; and a superposition module 605, configured to superpose the time-domain signal on a signal that is in the to-be-rendered BRIR signal and that is in a second time period after the first time period, to obtain a BRIR signal of the target elevation angle.

In an optional embodiment, the correction module 603 is configured to: determine a correction coefficient based on the target elevation angle and a correction function, where the correction function includes a numerical relationship between coefficients of HRTF signals corresponding to different elevation angles; and correct, based on the correction coefficient, the frequency-domain signal corresponding to the direct sound signal, to obtain the corrected frequency-domain signal.

In another optional embodiment, the correction module 603 is configured to: correct, based on the target elevation angle, at least one piece of information about a peak point or a valley point in a spectral envelope corresponding to the direct sound signal, to obtain at least one piece of corrected information about the peak point or the valley point, where the at least one piece of corrected information about the peak point or the valley point corresponds to the target elevation angle;

determine a target filter based on the at least one piece of corrected information about the peak point or the valley point; and filter the direct sound signal by using the target filter, to obtain the corrected frequency-domain signal.

In another optional embodiment, the time-domain signal obtaining module 604 is configured to: determine an energy adjustment coefficient based on the target elevation angle and an energy adjustment function, where the energy adjustment function includes a numerical relationship between frequency band energy of the HRTF signals corresponding to different elevation angles; adjust the corrected frequency-domain signal based on the energy adjustment coefficient to obtain an adjusted frequency-domain signal; and perform frequency-time conversion on the adjusted frequency-domain signal to obtain the time-domain signal.

In another optional embodiment, the direct sound signal obtaining module 602 is configured to: extract a signal in the first time period from the to-be-rendered BRIR signal; and process the signal in the first time period by using a Hanning window, to obtain the direct sound signal.

In another optional embodiment, the direct sound signal obtaining module 602 is configured to: extract a signal in the first time period from the to-be-rendered BRIR signal; and process the signal in the first time period by using a Hanning window, to obtain the direct sound signal; and the time-domain signal obtaining module 604 is configured to: superpose the corrected frequency-domain signal on a spectrum detail 604, where the spectrum detail is a difference between a spectrum of the signal in the first time period and a spectrum of the direct sound signal; and perform frequency-time conversion on a signal obtained through superposition, to obtain the time-domain signal.

In another optional embodiment, the direct sound signal obtaining module 602 is configured to: extract a signal in the first time period from the to-be-rendered BRIR signal; and process the signal in the first time period by using a Hanning window, to obtain the direct sound signal; and the time-domain signal obtaining module 604 is configured to: superpose a spectrum of the corrected frequency-domain signal on a spectrum detail, where the spectrum detail is a difference between a spectrum of the signal in the first time period and a spectrum of the direct sound signal; determine an energy adjustment coefficient based on the target elevation angle and an energy adjustment function, where the energy adjustment function includes a numerical relationship between frequency band energy of the HRTF signals corresponding to different elevation angles; adjust, based on the energy adjustment coefficient, a signal corresponding to a spectrum obtained through superposition, to obtain an adjusted frequency-domain signal; and perform frequency-time conversion on the adjusted frequency-domain signal to obtain the time-domain signal.

Figure 7:
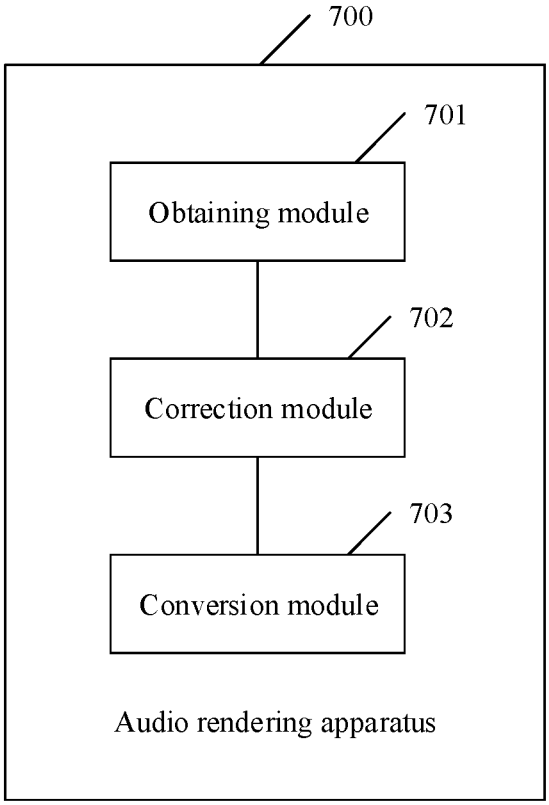
FIG. 7 is another schematic diagram of an audio rendering apparatus according to this application.

Referring to FIG. 7, another embodiment of an audio rendering apparatus 700 provided in this application includes:

an obtaining module 701, configured to obtain a to-be-rendered BRIR signal, where an elevation angle corresponding to the to-be-rendered BRIR signal is 0 degrees;

a correction module 702, configured to correct, based on a target elevation angle, a frequency-domain signal corresponding to the to-be-rendered BRIR signal; and a conversion module 703, configured to perform frequency-time conversion on a corrected frequency-domain signal to obtain a BRIR signal of the target elevation angle.

In an optional embodiment, the correction module 702 is configured to: determine a correction coefficient based on the target elevation angle and a correction function, where the correction function includes a numerical relationship between coefficients of HRTF signals corresponding to different elevation angles; and process, by using the correction coefficient, the frequency-domain signal corresponding to the to-be-rendered BRIR signal, to obtain the corrected frequency-domain signal.

Figure 8:
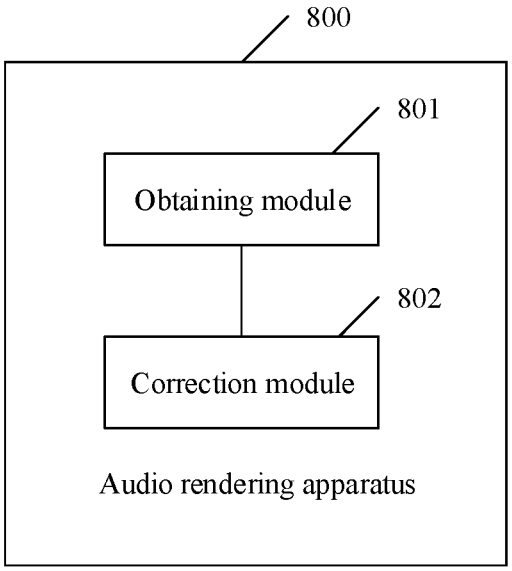
FIG. 8 is another schematic diagram of an audio rendering apparatus according to this application.

Referring to FIG. 8, this application provides an audio rendering apparatus 800, including:

an obtaining module 801, configured to obtain a to-be-rendered BRIR signal, where an elevation angle corresponding to the to-be-rendered BRIR signal is 0 degrees, and the obtaining module 801 is further configured to obtain an HRTF spectrum corresponding to a target elevation angle; and a correction module 802, configured to correct the to-be-rendered BRIR signal based on the HRTF spectrum corresponding to the target elevation angle, to obtain a BRIR signal of the target elevation angle.

Figure 9:
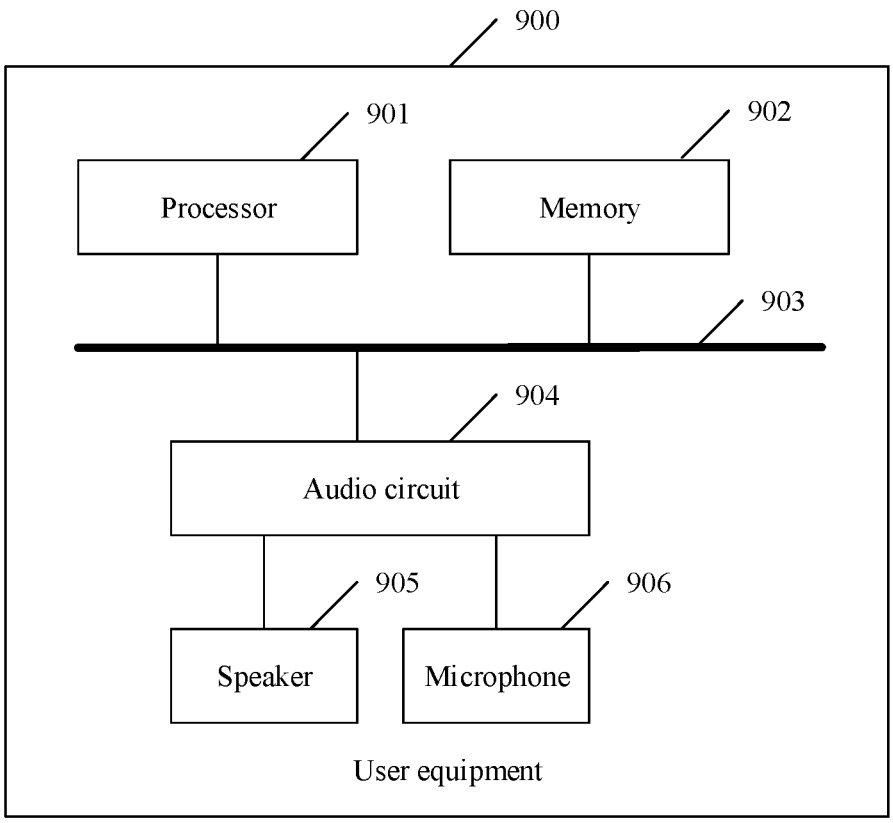
FIG. 9 is a schematic diagram of user equipment according to this application.

According to the methods provided in this application, this application provides user equipment 900, configured to implement a function of the audio rendering apparatus 600, the audio rendering apparatus 700, or the audio rendering apparatus 800 in the methods. As shown in FIG. 9, the user equipment 900 includes a processor 901, a memory 902, and an audio circuit 904. The processor 901, the memory 902, and the audio circuit 904 are connected by using a bus 903, and the audio circuit 904 is separately connected to a speaker 905 and a microphone 906 by using an audio interface.

The processor 901 may be a general-purpose processor, including a central processing unit (CPU), a network processor (NP), or the like. Alternatively, the processor 901 may be a digital signal processor (DSP), an application-specific integrated circuit (ASIC), a field programmable gate array (FPGA) or another programmable logic device, or the like.

The memory 902 is configured to store a program. The program may include program code, and the program code includes computer operation instructions. The memory 902 may include a random access memory (RAM), and may further include a non-volatile memory (NVM), for example, at least one magnetic disk memory. The processor 901 executes the program code stored in the memory 902, to implement the method in the embodiment or the optional embodiment shown in FIG. 1, FIG. 2, or FIG. 3.

The audio circuit 904, the speaker 905, and the microphone 906 may provide an audio interface between a user and the user equipment 900. The audio circuit 904 may convert audio data into an electrical signal, and then transmit the electrical signal to the speaker 905, and the speaker 905 converts the electrical signal into a sound signal for output. In addition, the microphone 906 may convert a collected sound signal into an electrical signal. The audio circuit 904 receives the electrical signal, converts the electrical signal into audio data, and then outputs the audio data to the processor 901 for processing. After the processing, the processor 901 sends the audio data to, for example, other user equipment through a transmitter, or outputs the audio data to the memory 902 for further processing. It may be understood that the speaker 905 may be integrated into the user equipment 900, or may be used as an independent device. For example, the speaker 905 may be disposed in a headset connected to the user equipment 900.

All or some of the foregoing embodiments may be implemented by using software, hardware, firmware, or any combination thereof. When software is used to implement the embodiments, all or some of the embodiments may be implemented in a form of a computer program product.

The computer program product includes one or more computer instructions. When the computer program instructions are loaded and executed on a computer, the procedure or functions according to the embodiments of the present application are all or partially generated. The computer may be a general-purpose computer, a dedicated computer, a computer network, or another programmable apparatus. The computer instructions may be stored in a computer-readable storage medium or may be transmitted from a computer-readable storage medium to another computer-readable storage medium. For example, the computer instructions may be transmitted from a website, computer, server, or data center to another website, computer, server, or data center in a wired (for example, a coaxial cable, an optical fiber, or a digital subscriber line) or wireless (for example, infrared, radio, or microwave) manner. The computer-readable storage medium may be any usable medium accessible by a computer, or a data storage device, such as a server or a data center, integrating one or more usable media. The usable medium may be a magnetic medium (for example, a floppy disk, a hard disk, or a magnetic tape), an optical medium (for example, a DVD), a semiconductor medium (for example, a solid-state drive (SSD)), or the like.

The foregoing embodiments are merely intended for describing the technical solutions of this application, but not for limiting this application. Although this application is described in detail with reference to the foregoing embodiments, persons of ordinary skill in the art should understand that they may still make modifications to the technical solutions described in the foregoing embodiments or make equivalent replacements to some technical features thereof, without departing from the scope of the technical solutions of the embodiments of this application.

What is claimed is:

1. An audio rendering method, comprising:

obtaining a to-be-rendered binaural room impulse response (BRIR) signal, wherein an elevation angle corresponding to the to-be-rendered BRIR signal is 0 degrees;

obtaining a direct sound signal based on the to-be-rendered BRIR signal, wherein the direct sound signal corresponds to a first time period in a time period corresponding to the to-be-rendered BRIR signal;

correcting, based on a target elevation angle, a frequency-domain signal corresponding to the direct sound signal, to obtain a frequency-domain signal corresponding to the target elevation angle;

obtaining a time-domain signal based on the frequency-domain signal of the target elevation angle; and superposing the time-domain signal on a signal that is in the to-be-rendered BRIR signal and that is in a second time period after the first time period, to obtain a BRIR signal of the target elevation angle.

2. The method according to claim 1, wherein the correcting, based on a target elevation angle, a frequency-domain signal corresponding to the direct sound signal comprises:

determining a correction coefficient based on the target elevation angle and a correction function, wherein the correction function comprises a numerical relationship between coefficients of head related transfer function (HRTF) signals corresponding to different elevation angles; and correcting, based on the correction coefficient, the frequency-domain signal corresponding to the direct sound signal, to obtain the corrected frequency-domain signal.

3. The method according to claim 1, wherein the correcting, based on a target elevation angle, a frequency-domain signal corresponding to the direct sound signal comprises:

correcting, based on the target elevation angle, at least one piece of information about a peak point or a valley point in a spectral envelope corresponding to the direct sound signal, to obtain at least one piece of corrected information about the peak point or the valley point;

determining a target filter based on the at least one piece of corrected information about the peak point or the valley point; and filtering the direct sound signal using the target filter, to obtain the corrected frequency-domain signal.

4. The method according to claim 1, wherein the obtaining a time-domain signal based on the corrected frequency-domain signal comprises:

determining an energy adjustment coefficient based on the target elevation angle and an energy adjustment function, wherein the energy adjustment function comprises a numerical relationship between frequency band energy of head related transfer function (HRTF) signals corresponding to different elevation angles;

adjusting the corrected frequency-domain signal based on the energy adjustment coefficient to obtain an adjusted frequency-domain signal; and performing frequency-time conversion on the adjusted frequency-domain signal to obtain the time-domain signal.

5. The method according to claim 1, wherein the obtaining a direct sound signal based on the to-be-rendered BRIR signal comprises:

extracting a signal in the first time period from the to-be-rendered BRIR signal, and processing the signal in the first time period using a Hanning window, to obtain the direct sound signal.

6. The method according to claim 5, wherein the obtaining a time-domain signal based on the corrected frequency-domain signal comprises:

superposing a spectrum of the corrected frequency-domain signal on a spectrum detail, wherein the spectrum detail is a difference between a spectrum of the signal in the first time period and a spectrum of the direct sound signal; and performing frequency-time conversion on a signal corresponding to a spectrum obtained through superposition, to obtain the time-domain signal.

7. The method according to claim 5, the obtaining a time-domain signal based on the corrected frequency-domain signal comprises:

superposing a spectrum of the corrected frequency-domain signal on a spectrum detail, wherein the spectrum detail is a difference between a spectrum of the signal in the first time period and a spectrum of the direct sound signal;

determining an energy adjustment coefficient based on the target elevation angle and an energy adjustment function, wherein the energy adjustment function comprises a numerical relationship between frequency band energy of the HRTF signals corresponding to different elevation angles;

adjusting, based on the energy adjustment coefficient, a signal corresponding to a spectrum obtained through superposition, to obtain an adjusted frequency-domain signal; and performing frequency-time conversion on the adjusted frequency-domain signal to obtain the time-domain signal.

8. An audio rendering method, comprising:

obtaining a to-be-rendered binaural room impulse response (BRIR) signal, wherein an elevation angle corresponding to the to-be-rendered BRIR signal is 0 degrees;

correcting, based on a target elevation angle, a frequency-domain signal corresponding to the to-be-rendered BRIR signal; and performing frequency-time conversion on a corrected frequency-domain signal to obtain a BRIR signal of the target elevation angle.

9. The method according to claim 8, wherein the correcting, based on a target elevation angle, a frequency-domain signal corresponding to the to-be-rendered BRIR signal comprises:

determining a correction coefficient based on the target elevation angle and a correction function, wherein the correction function comprises a numerical relationship between spectrums of head related transfer function (HRTF) signals corresponding to different elevation angles; and processing, using the correction coefficient, the frequency-domain signal corresponding to the to-be-rendered BRIR signal, to obtain the corrected frequency-domain signal.

10. An audio rendering method, comprising:

obtaining a to-be-rendered binaural room impulse response BRIR signal, wherein an elevation angle corresponding to the to-be-rendered BRIR signal is 0 degrees;

obtaining a head related transfer function (HRTF) spectrum corresponding to a target elevation angle; and correcting the to-be-rendered BRIR signal based on the HRTF spectrum corresponding to the target elevation angle, to obtain a BRIR signal of the target elevation angle.

11. An audio rendering apparatus, comprising:

a memory storing instructions; and a processor, wherein execution of the instructions by the processor cause the apparatus to:

obtain a to-be-rendered binaural room impulse response BRIR signal, wherein an elevation angle corresponding to the to-be-rendered BRIR signal is 0 degrees;

obtain a direct sound signal based on the to-be-rendered BRIR signal, wherein the direct sound signal corresponds to a first time period in a time period corresponding to the to-be-rendered BRIR signal;

correct, based on a target elevation angle, a frequency-domain signal corresponding to the direct sound signal, to obtain a frequency-domain signal corresponding to the target elevation angle;

obtain a time-domain signal based on the frequency-domain signal of the target elevation angle; and superpose the time-domain signal on a signal that is in the to-be-rendered BRIR signal and that is in a second time period after the first time period, to obtain a BRIR signal of the target elevation angle.

12. The apparatus according to claim 11, wherein execution of the instructions by the processor further cause the apparatus to:

determine a correction coefficient based on the target elevation angle and a correction function, wherein the correction function comprises a numerical relationship between coefficients of head related transfer function (HRTF) signals corresponding to different elevation angles; and correct, based on the correction coefficient, the frequency-domain signal corresponding to the direct sound signal, to obtain the corrected frequency-domain signal.

13. The apparatus according to claim 11, wherein execution of the instructions by the processor further cause the apparatus to:

correct, based on the target elevation angle, at least one piece of information about a peak point or a valley point in a spectral envelope corresponding to the direct sound signal, to obtain at least one piece of corrected information about the peak point or the valley point;

determine a target filter based on the at least one piece of corrected information about the peak point or the valley point; and filter the direct sound signal using the target filter, to obtain the corrected frequency-domain signal.

14. The apparatus according to claim 11, wherein execution of the instructions by the processor further cause the apparatus to:

determine an energy adjustment coefficient based on the target elevation angle and an energy adjustment function, wherein the energy adjustment function comprises a numerical relationship between frequency band energy of head related transfer function (HRTF) signals corresponding to different elevation angles; and adjust the corrected frequency-domain signal based on the energy adjustment coefficient to obtain an adjusted frequency-domain signal, and perform frequency-time conversion on the adjusted frequency-domain signal to obtain the time-domain signal.

15. The apparatus according to claim 11, wherein execution of the instructions by the processor further cause the apparatus to:

extract a signal in the first time period from the to-be-rendered BRIR signal; and process the signal in the first time period using a Hanning window, to obtain the direct sound signal.

16. The apparatus according to claim 15, wherein execution of the instructions by the processor further cause the apparatus to:

superpose a spectrum of the corrected frequency-domain signal on a spectrum detail, wherein the spectrum detail is a difference between a spectrum of the signal in the first time period and a spectrum of the direct sound signal; and perform frequency-time conversion on a signal corresponding to a spectrum obtained through superposition, to obtain the time-domain signal.

17. An audio rendering apparatus, comprising:

a memory storing instructions; and a processor, wherein execution of the instructions by the processor cause the apparatus to:

obtain a to-be-rendered binaural room impulse response BRIR signal, wherein an elevation angle corresponding to the to-be-rendered BRIR signal is 0 degrees;

correct, based on a target elevation angle, a frequency-domain signal corresponding to the to-be-rendered BRIR signal; and perform frequency-time conversion on a corrected frequency-domain signal to obtain a BRIR signal of the target elevation angle.

18. The apparatus according to claim 17, wherein execution of the instructions by the processor further cause the apparatus to:

determine a correction coefficient based on the target elevation angle and a correction function, wherein the correction function comprises a numerical relationship between coefficients of head related transfer function (HRTF) signals corresponding to different elevation angles; and process, using the correction coefficient, the frequency-domain signal corresponding to the to-be-rendered BRIR signal, to obtain the corrected frequency-domain signal.

19. An audio rendering apparatus, comprising:

a memory storing instructions; and a processor, wherein execution of the instructions by the processor cause the apparatus to:

obtain a to-be-rendered binaural room impulse response BRIR signal, wherein an elevation angle corresponding to the to-be-rendered BRIR signal is 0 degrees, and obtain a head related transfer function (HRTF) spectrum corresponding to a target elevation angle; and correct the to-be-rendered BRIR signal based on the HRTF spectrum corresponding to the target elevation angle, to obtain a BRIR signal of the target elevation angle.

20. A non-transitory computer storage medium, comprising instructions, wherein when the instructions are run on a computer, the computer is enabled to perform the method according to claim 1.

* * * * *